US009796006B2

(12) United States Patent
Lengauer et al.

(10) Patent No.: US 9,796,006 B2
(45) Date of Patent: Oct. 24, 2017

(54) METHOD AND DEVICE FOR A COMBINED CONTINUOUS CASTING AND ROLLING SYSTEM

(71) Applicant: PRIMETALS TECHNOLOGIES AUSTRIA GMBH, Linz (AT)

(72) Inventors: Thomas Lengauer, Linz (AT); Wolfgang Peitl, St. Florian (AT); Roman Winkler, Altenberg (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 0 days.

(21) Appl. No.: 14/420,395

(22) PCT Filed: Jul. 4, 2013

(86) PCT No.: PCT/EP2013/064136

§ 371 (c)(1),
(2) Date: Feb. 9, 2015

(87) PCT Pub. No.: WO2014/029544

PCT Pub. Date: Feb. 27, 2014

(65) Prior Publication Data

US 2015/0196941 A1 Jul. 16, 2015

(30) Foreign Application Priority Data

Aug. 20, 2012 (AT) ..... A 50328/2012

(51) Int. Cl.
*B22D 11/12* (2006.01)
*B22D 11/126* (2006.01)
(Continued)

(52) U.S. Cl.
CPC ..... *B21B 1/463* (2013.01); *B22D 11/1206* (2013.01); *B22D 11/126* (2013.01); *B22D 11/14* (2013.01); *B21B 2015/0014* (2013.01)

(58) Field of Classification Search
CPC ... B22D 11/1206; B22D 11/126; B22D 11/14; B21B 1/46; B21B 1/463; B21B 2015/0014
(Continued)

(56) References Cited

U.S. PATENT DOCUMENTS 5,205,471 A 4/1993 Kinose et al.
5,490,315 A 2/1996 Kostopolos et al.
(Continued)

FOREIGN PATENT DOCUMENTS

CN 1092343 A 9/1994
CN 1195585 A 10/1998
(Continued)

OTHER PUBLICATIONS

International Search Report dated Nov. 4, 2013 issued in corresponding International patent application No. PCT/EP2013/064136.
(Continued)

*Primary Examiner* — Kevin P Kerns
(74) *Attorney, Agent, or Firm* — Ostrolenk Faber LLP

(57) ABSTRACT

A method and device for producing hot-rolled products in a combined continuous casting and rolling system includes a device for separating and removing. In order to overcome a disruption in production in a part of the system located downstream of the device for separating and removing, the method includes: (a) separating the endlessly produced precursor material into a strand portion with shears; (b) clamping the strand portion; (c) raising the trailing part of the strand portion from the roller table by a raising device, so that the strand portion is drawn away from the shears in the direction of transport; (d) cutting the precursor material into a precursor material portion with the shears; (e) removing the precursor material portion from the roller table, and
(Continued)

removing the strand portion until the combined continuous casting and rolling system is ready to operate again.

6 Claims, 5 Drawing Sheets

(51) Int. Cl.
*B21B 1/46* (2006.01)
*B22D 11/14* (2006.01)
*B21B 15/00* (2006.01)

(58) Field of Classification Search
USPC ..... 164/460, 476, 263, 269, 417; 29/527.6, 29/527.7
See application file for complete search history.

(56) References Cited

U.S. PATENT DOCUMENTS

| | | | | |
|---|---|---|---|---|
| 5,810,069 | A | 9/1998 | Flick et al. | 164/476 |
| 7,028,750 | B2 | 4/2006 | Bowles et al. | |
| 8,453,711 | B2 | 6/2013 | Hohenbichler et al. | |
| 2010/0275667 | A1 | 11/2010 | Seidel et al. | |
| 2011/0272116 | A1 | 11/2011 | Benedetti et al. | 164/462 |
| 2012/0291248 | A1 | 11/2012 | Hohenbichler et al. | 29/33 C |

FOREIGN PATENT DOCUMENTS

| | | | |
|---|---|---|---|
| CN | 101848776 | A | 9/2010 |
| CN | 102056690 | A | 5/2011 |
| DE | 2 003 263 | A1 | 8/1971 |
| DE | 692 06 178 | | 7/1996 |
| EP | 2 286 940 | A2 | 2/2011 |
| GB | 2 322 320 | A | 8/1998 |
| JP | 55-45530 | | 3/1980 |
| JP | 55-100804 | | 8/1980 |
| RU | 2114708 | C1 | 7/1998 |
| RU | 2010122686 | A | 12/2011 |
| WO | WO 2009/036894 | A1 | 3/2009 |
| WO | WO 2009/121678 | A1 | 10/2009 |

OTHER PUBLICATIONS

Office Action dated Sep. 22, 2015 issued in corresponding Chinese Patent Application No. 201383044458.0 with English translation.
Russian Federation Office Action dated May 17, 2017 in corresponding Russian Federation Patent Application No. 2015109751/02(015432) with German translation.

METHOD AND DEVICE FOR A COMBINED CONTINUOUS CASTING AND ROLLING SYSTEM

CROSS-REFERENCE TO RELATED APPLICATIONS

The present application is a 35 U.S.C. §§371 national phase conversion of PCT/EP2013/064136, filed Jul. 4, 2013, which claims priority of Austrian Patent Application No. A50328/2012, filed Aug. 20, 2012, the contents of which are incorporated by reference herein. The PCT International Application was published in the German language.

FIELD OF TECHNOLOGY

The present invention relates to a method and an apparatus for manufacturing hot-rolled products in a combined casting-rolling installation.

On the one hand the invention relates to a method for manufacturing hot-rolled products in a combined casting-rolling installation. In continuous operation, a strand with a slab or thin slab cross-section of an endless strand-cast preliminary material, after its complete solidifying, passes uncut, i.e. in a strand, through a cutting up and delivery device on a roller table in a transport direction. The strand is subsequently hot rolled in a finishing rolling train, then cooled down, cut up and stored.

On the other hand the invention relates to a combined casting-rolling installation for manufacturing hot-rolled products, having

- a continuous casting machine for continuous casting of a strand of an endless preliminary material with a slab or thin slab cross-section; then
- a cutting up and delivery device, comprising shears for cutting the preliminary material to a strand portion or to a preliminary material portion, a raising device for raising a tail part of the strand portion and a delivery device for pushing the preliminary material portion; followed by
- a finishing rolling train; then
- a cooling section; and then
- a storage device

PRIOR ART

The applicant's patent publication WO 2009/121678 A1 discloses a method and a so-called cutting up and delivery device for a combined casting-rolling installation. Those make it possible to bridge a fault in a part of the installation after the cutting up and delivery device, without a casting operation having to be interrupted in the continuous casting machine during the occurrence. This significantly increases the operational safety of the installation. In concrete terms the cutting up and delivery device has two pairs of shears and a delivery device lying between the shears, so that continuously produced preliminary material can be delivered during the fault as a preliminary material portion. In the event of a fault, in order to prevent a collision between the continuously-produced preliminary material and the material in the combined casting-rolling installation, a raising device is disposed downstream of the rear shears. Although this solution has been proven in practice, it has the disadvantage that the cutting up and delivery device has a total length of around 15 m. As a consequence of the great length, the strip cools down more on the way to the finishing rolling train, more blisters occur on the strip and the capital investment costs (CAPEX) and the operating costs (OPEX) increase.

The publication does not disclose how, with a comparatively high level of operational safety, the length of the cutting up and delivery device can be reduced and the capital investment and operating costs of the combined casting-rolling mill can be reduced.

SUMMARY OF THE INVENTION

The object of the invention is to overcome the disadvantages of the prior art and to disclose a method which is not susceptible to faults and a compact combined casting-rolling installation, with which

- a fault in a part of the installation downstream of the cutting up and delivery device can be bypassed without continuous casting operation of the strand casting machine having to be interrupted in such cases,
- the overall length of the cutting up and delivery device can be reduced and
- the capital investment and operating costs of the combined casting-rolling installation can be reduced.

This object is achieved for the method cited at the start in that for bridging an interruption in production in a part of the installation which is downstream of the cutting up and delivery device, the following method steps are carried out in the cutting up and delivery device:

a) Cutting the continuously produced preliminary material into a strand portion by a pair of shears;
b) Clamping of the strand portion by a clamping device;
c) Raising of the tail part of the strand portion from the roller table by means of the raising device, through which the tail of the strand portion is pulled away from the shears in the transport direction;
d) Cutting the preliminary material passing the shears into a preliminary material portion by means of the shears;
e) Delivery of the preliminary material portion from the roller table by a delivery device, and removal of the strand portion until operational readiness of the combined casting-rolling installation is restored.

Immediately after a fault has occurred in the part of the installation which is disposed behind the cutting up and delivery device (e.g. the single- or multi-stand finishing train), the preliminary material continuously produced by a strand casting machine, for example for slab or thin slab cross sections or the pre-rolled preliminary material coming from a pre-rolling train (typically consisting of steel), is cut off by the shears. This cut produces a strand portion which extends from the shears in the transport direction. The strand portion is clamped by a clamping device which is disposed in the transport direction downstream of the shears, a raising device and a delivery device but upstream of the finishing rolling train for example, so that the tail of the strand portion is pulled away from the shears by the immediately following raising of the tail part of the strand portion, i.e. is moved in the transport direction. The raising of the strand portion means that not only is the roller table which is assigned to the delivery device freed up, but the tail of the strand portion is moved in the transport direction. These steps thus have the effect of freeing the roller table in the cutting up and delivery device and putting a distance between the tail of the strand portion and the preliminary material still being continuously produced. Thus the casting operation of the continuous casting machine does not have to be interrupted in the event of a fault. The preliminary material which continues to be produced is subsequently cut by the shears into preliminary material portions so that these preliminary material portions can be pushed and if necessary supplied for finishing in a hot rolling mill. Finally the raised strand portion must be removed until the operational readiness of the continuous casting-rolling installation is restored.

To ensure that the portion is clamped securely even with an oily or greasy surface of the strand portion, it is advantageous if, during clamping, at least one pair of opposing strand guidance rollers are pressed onto the strand portion by an actuation device.

It is advantageous for the raising of the tail part of the strand portion to be carried out in a vertical direction by a typically horizontal raising bar. This rapidly frees up the roller table lying below it. In such cases the raising part can extend in the raised state in the horizontal direction or the transverse direction for example.

To make finishing of the continuously-produced preliminary material in conventional hot rolling trains possible, it is advantageous for the shears to cut the preliminary material passing the shears into preliminary material portions with a length of 8 to 14 m. As an alternative to this it is possible for the shears to create so-called scrap pieces with a length of typically around 1 m.

It is expedient if, during delivery, the preliminary material portion is moved transverse to the transport direction (e.g. in the horizontal direction) off the roller table. The space next to the roller table is thereby effectively used for intermediate storage of the preliminary material portions, for example by a stacking device.

It is also expedient to raise the strand portion in a vertical direction using a crane during removal.

The said object is likewise achieved by a combined casting-rolling installation of the type cited at the start, in which the cutting up and delivery device additionally comprises a clamping device for clamping the strand portion, wherein the clamping device is located downstream from the raising device in the transport direction. The clamping device ensures that the tail of the strand portion is automatically pulled away from the shears by the raising of the strand portion. This prevents a collision between the preliminary material coming afterwards and the strand portion.

Preferably the shears are pendulum shears or drum shears.

It is expedient for the clamping device to comprise an actuation device and two strand guidance rollers in a plane normal to the transport direction, wherein the strand guidance rollers are able to be pressed onto the strand portion by the actuation device. The strand guidance rollers are pressed onto the strand portion via the actuation device here so that the strand portion is clamped via friction between the strand guidance rollers and the strand portion.

The actuation device is especially robust if it is embodied as a hydraulic cylinder. In addition, with a hydraulic cylinder, the clamping force can be easily set and limited by the hydraulic pressure.

With a simple and functional raising device, the raising device comprises at least one raising cylinder and at least one raising bar aligned transverse to the transport direction, wherein the raising bar is raised and lowered again in a vertical direction by the raising cylinder.

With a simple and functional delivery device, the delivery device comprises at least one pusher cylinder, wherein a preliminary material portion can be pushed by the pusher cylinder off the roller table transverse to the transport direction (e.g. in a horizontal direction).

In an especially compact cutting up and delivery device a raising device is disposed in the transport direction between two delivery devices or a delivery device is disposed between two raising devices. For example a raising device and/or a delivery device is disposed between two roller table rollers following each other in the transport direction. This provides sufficient support for the preliminary material on the roller table and the raising device and/or the delivery device is integrated in an extremely compact manner into the roller table.

The spatial restriction of the delivery device and the raising device means that the overall length of the cutting up and delivery device is greatly reduced. The capital investment costs and the operating costs also fall as a result, since the preliminary material is less heavily cooled (and thus has to be heated up again less strongly). Fewer blisters also occur on the strip as a result, so that the strip has to be less heavily de-blistered, whereby the strip for its part cools down less. In addition the quality is improved by this method.

As an alternative or in addition to the spatial restriction it is advantageous for the raising device in the lowered state and the delivery device to be disposed in a single area of a roller table between the shears and the clamping device.

BRIEF DESCRIPTION OF THE DRAWINGS

Further advantages and features of the present invention emerge from the description given below of the non-restrictive exemplary embodiments, wherein reference is made to the following figures, in which.

DESCRIPTION OF THE EMBODIMENTS

Figure 1:
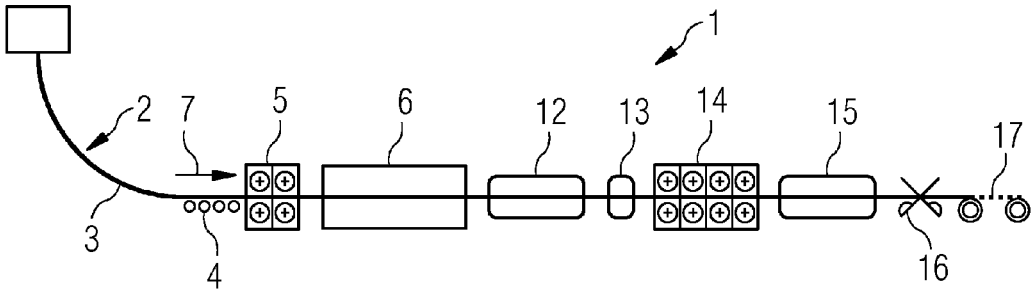
FIG 1 Prior art
FIG. 1 shows a schematic diagram of a combined casting-rolling installation for fully-continuous endless operation

FIG. 1 shows a combined casting-rolling installation 1 known from WO 2009/121678 A1. In normal operation a continuous casting machine 2 continuously produces a preliminary material 3 in the form of a thin slab strand, which is transported by a roller table 4 to a pre-rolling train 5. After pre-rolling in the pre-rolling train 5, the preliminary material 3 passes uncut, i.e. as a strand, through a cutting up and delivery device 6, before the temperature of the preliminary material is set in a heating section 12 to rolling temperature. After the preliminary material has been treated in a de-blistering apparatus 13 which is disposed upstream from a finishing rolling train 14, the de-blistered preliminary material is rolled in a single- or multi-stand finishing rolling train 14. The finished rolled material is subsequently cooled down in a cooling section 15, cut off by shears 16 to a specific product length or a specific product weight and subsequently wound by a storage device 17 embodied as a winding device. The roller table 4 connects all parts of the installation between the horizontal strand guides of the continuous casting machine 2 and the storage device 17.

Figure 2:
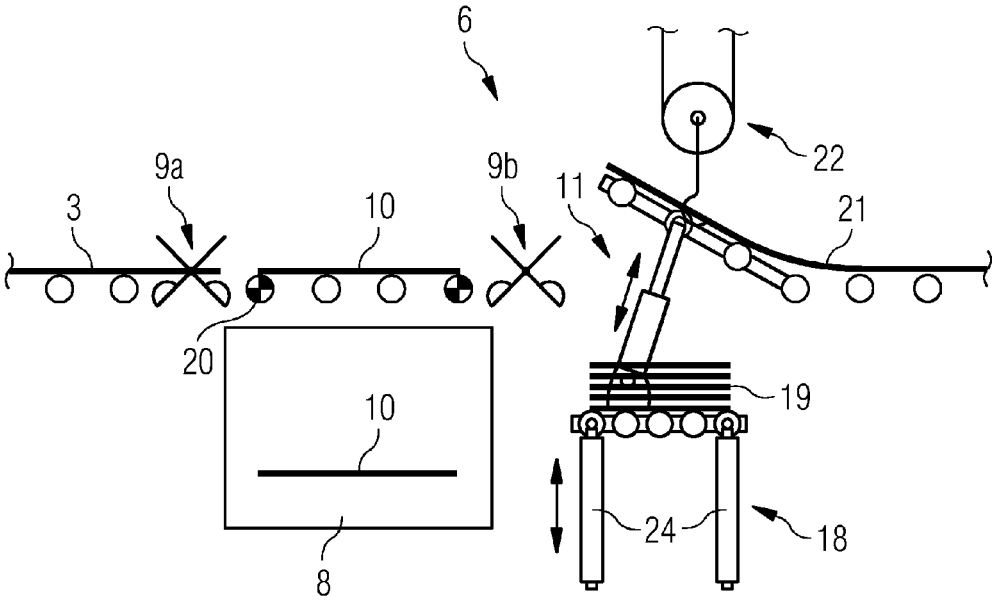
FIG 2 Prior art
FIG. 2 shows a schematic diagram of a cutting up and delivery device in accordance with the prior art FIGS. 3A and 3B respectively show a sectional view and plan view in a schematic diagram of a first form of embodiment of the inventive cutting up and delivery device FIG. 4A . . . 4F show a schematic diagram of the steps in the cutting up and delivery device for bridging an interruption in production FIGS. 5A and 5B respectively show a sectional view and plan view in a schematic diagram of a second embodiment of the inventive cutting up and delivery device

The cutting up and delivery device 6 of FIG. 1 is shown in FIG. 2, comprising a first pair of shears 9*a*, a delivery device 8, a second pair of shears 9*b*, a lowerable roller table 18 and a raising device 11. Immediately after the occurrence of a fault in a part of the installation which is located downstream from the cutting up and delivery device 6 (e.g. the finishing rolling train 14 or the winding device 17) the preliminary material 3 is cut off by the second pair of shears 9*b*, which forms a strand portion 21 behind the second pair of shears 9*b*. In order to separate the strand portion 21 from the preliminary material 3 which is still being continuously produced emanating from the pre-rolling train 5, the strand portion 21 is raised by a raising device 11. The preliminary material 3 passing the second pair of shears 9*b* is divided up by the shears 9*b* into pieces of scrap 19 which are pushed via a lowerable roller table 18. Since the pieces of scrap 19 are generally difficult to recycle, after the occurrence of the fault, the preliminary material 3 is cut by first shears 9*a* into preliminary material portions 10, which each have a length of 8-14 m, wherein the preliminary material portions 10 are pushed via the delivery device 8 transverse to the transport direction 7 from the roller table 4. The disadvantage of the cutting up and delivery device 6 according to the prior art is that the length of the device 6 amounts to around 16 m, the preliminary material 3 is cooled down relatively significantly by the length in endless operation, because of the delay time of the preliminary material 3 in the device 6 a relatively strong blistering is formed, and the capital investment and operating costs of the cutting up and delivery device 6 as well as the continuous casting-rolling installation 1 are relatively high.

Figure 3A:
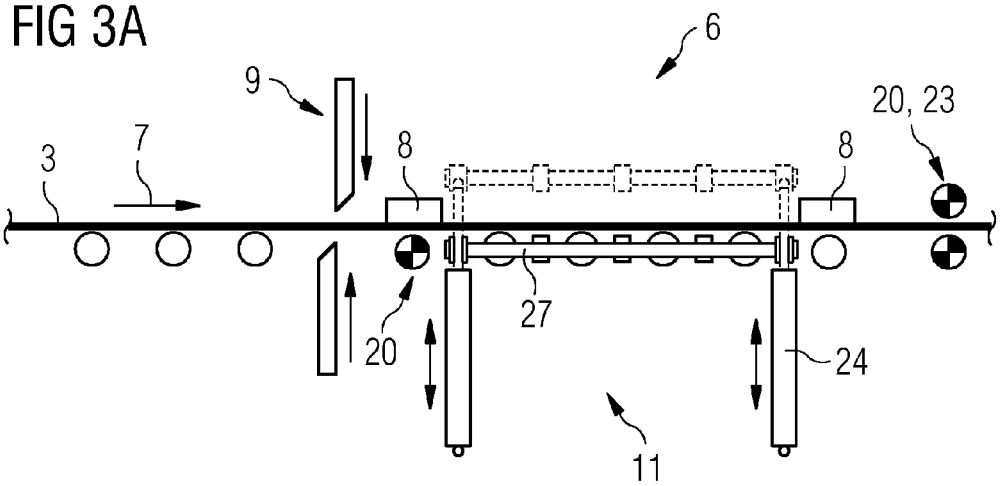
Figure 3B:
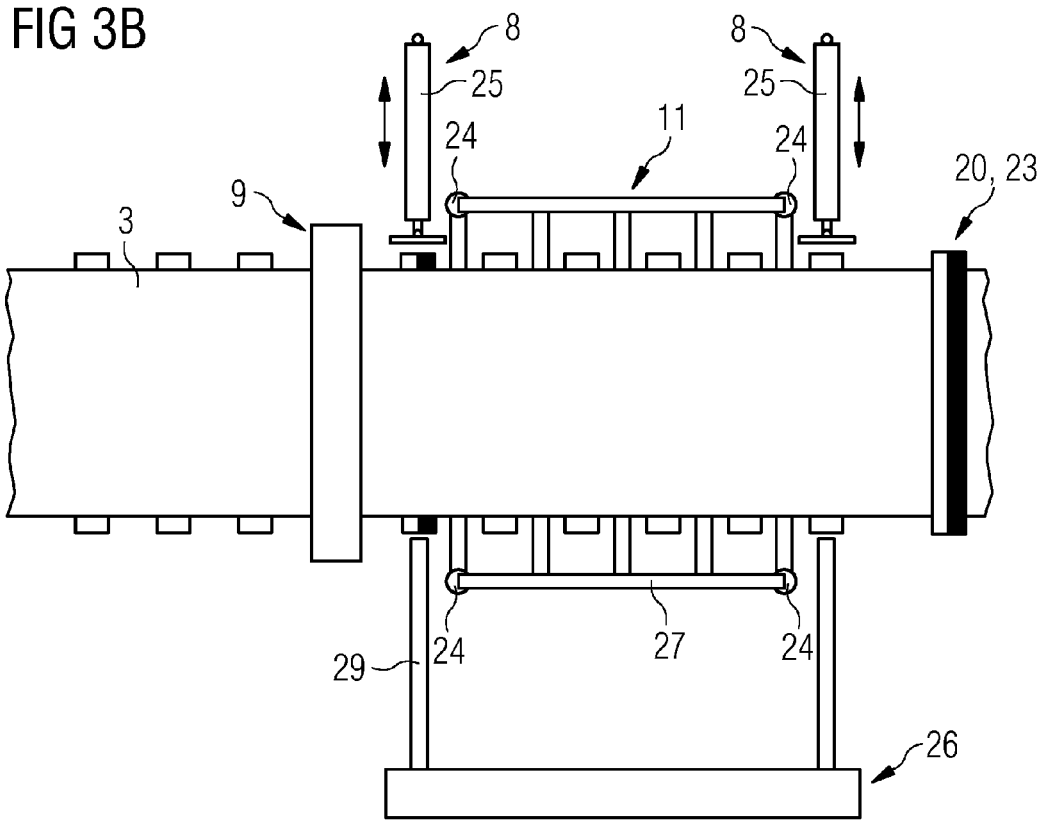

FIGS. 3A and 3B show a first embodiment of the inventive cutting up and delivery device 6 which no longer exhibits the disadvantages of the solution according to FIG. 2. Apart from the shorter length of the device 6, the inventive device 6 can also be used with the known combined casting-rolling installation 1 of FIG. 1. In concrete terms the cutting up and delivery device 6 now merely has one pair of shears 9 which are embodied as pendulum shears or as drum shears. The shears 9 are followed in the transport direction 7 by two delivery devices 8, between which a raising device 11 is disposed in the transport direction. The raising device 11 is shown in FIG. 3A, 3B by a solid outline in the lowered position and by a dashed outline in the raised position. Disposed downstream of the rear delivery device 8 is a clamping device 23 which is embodied as a pair of "pinch rolls") with which the strand portion 21 or the preliminary material 3 can be clamped. This prevents the strand portion 21 being moved against the transport direction 7 by the raising process. The clamping pushes the tail of the strand portion 21 in the transport direction 7 so that the preliminary material 3 coming after is at a sufficient distance from the strand portion 21.

Figure 4A:
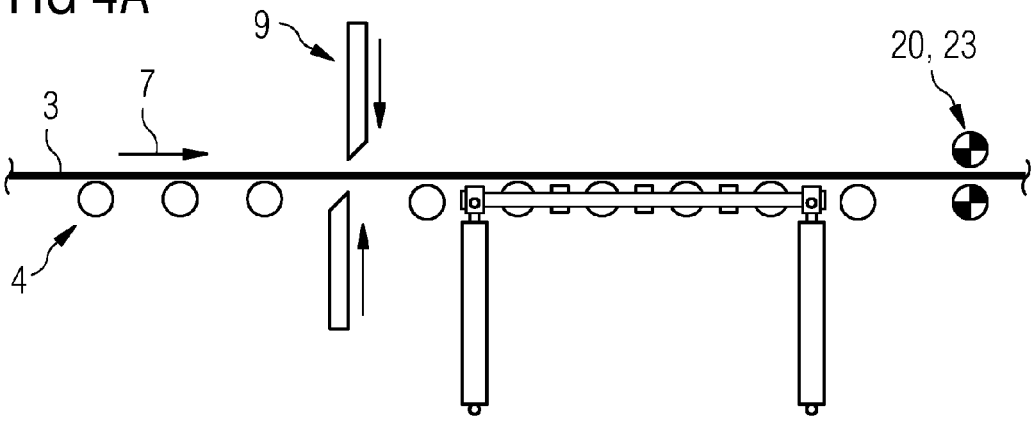
Figure 4B:
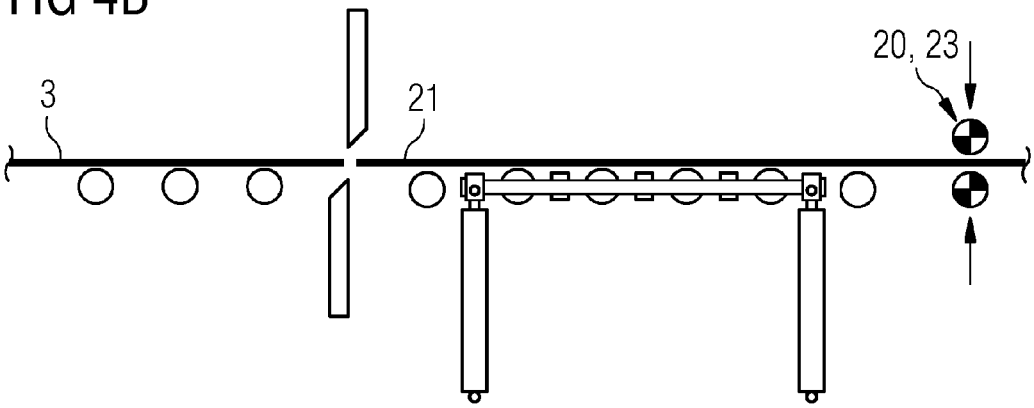
Figure 4C:
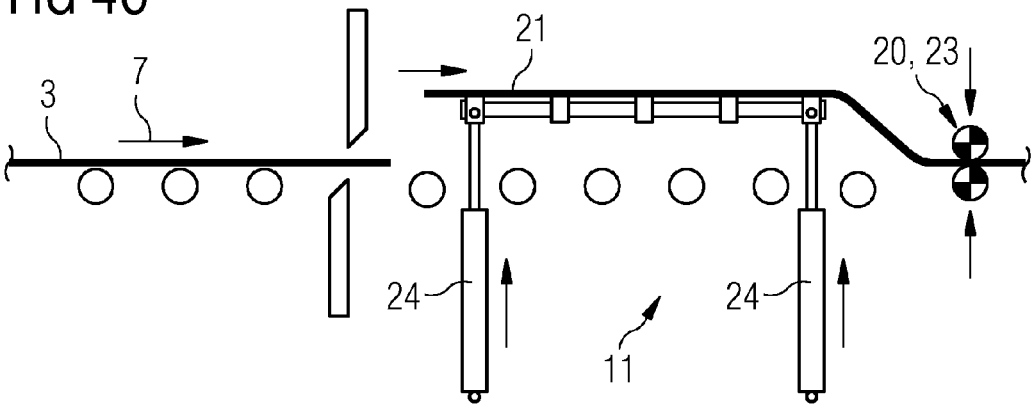
Figure 4D:
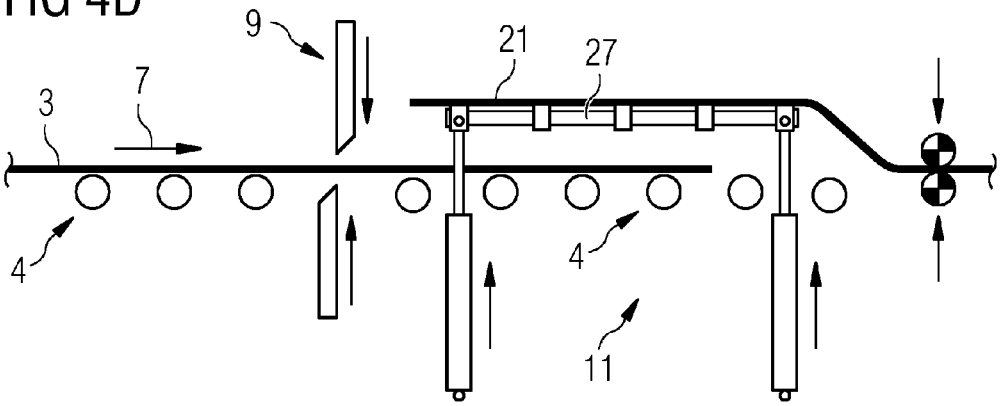
Figure 4E:
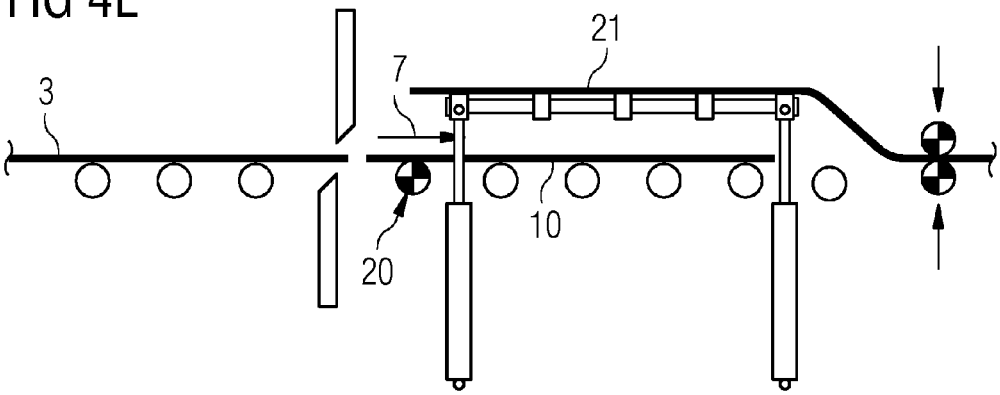
Figure 4F:
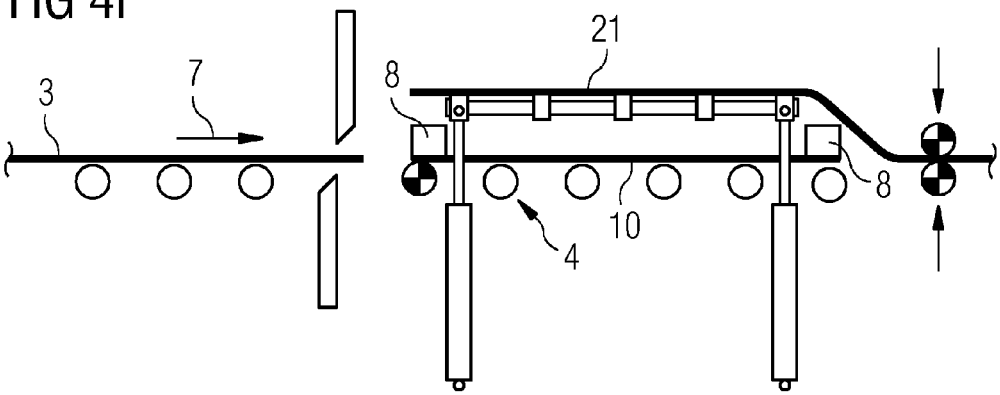

The method steps in the cutting up and delivery device 6 after the occurrence of a fault are shown in FIG. 4A . . . 4F. Shortly after or directly after the occurrence of a fault in a part of the installation which is disposed downstream from the cutting up and delivery device 6 the continuously produced preliminary material 3 coming from the preliminary rolling train 5 is cut off by the shears 9 which are embodied as pendulum shears (FIG. 4*a* shows the situation before the cut). A strand portion 21, which extends from the shears in the transport direction 7 is formed by the cutting-off. After the occurrence of the fault or before the raising of the strand portion 21 by the raising device 11, the strand portion is clamped by the clamping device 23, so that the tail of the strand portion 21 is not pulled by the raising against the transport direction 7 (FIG. 4B shows the situation directly before the clamping of the strand portion 21). In FIG. 4C the clamped strand portion 21 is lifted by the raising device 11 in a vertical direction, so that the strand portion 21 has a vertical offset to the following preliminary material 3 and the tail of the strand portion 21 is pulled away from the shears 9 in the transport direction 7 by the raising. Thus the tail of the strand portion 21 has a vertical and horizontal offset to the cutting plane of the shears 9. FIG. 4D shows that preliminary material 3 comes continuously from the preliminary rolling train 5, which is supported by the roller table 4. Since the head of the preliminary material 3 is at a specific distance (for example 10 m) from the shears 9, the shears 9 cut off a preliminary material portion 10 from the preliminary material 3. Directly after the cutting off the preliminary material portion 10 is accelerated in the transport direction by at least one driven roller 20, so that the preliminary material portion 10 is at a horizontal distance from the shears 9 (FIG. 4E shows the situation during acceleration). Finally the preliminary material portion 10 is pushed by the two delivery devices 8 before and after the raising device 11 out of the plane of the drawing, so that the roller table 4 is cleared between the two delivery devices 8. After the fault has been rectified, the strand portion 21 is removed for example by a crane 22.

Figure 5A:
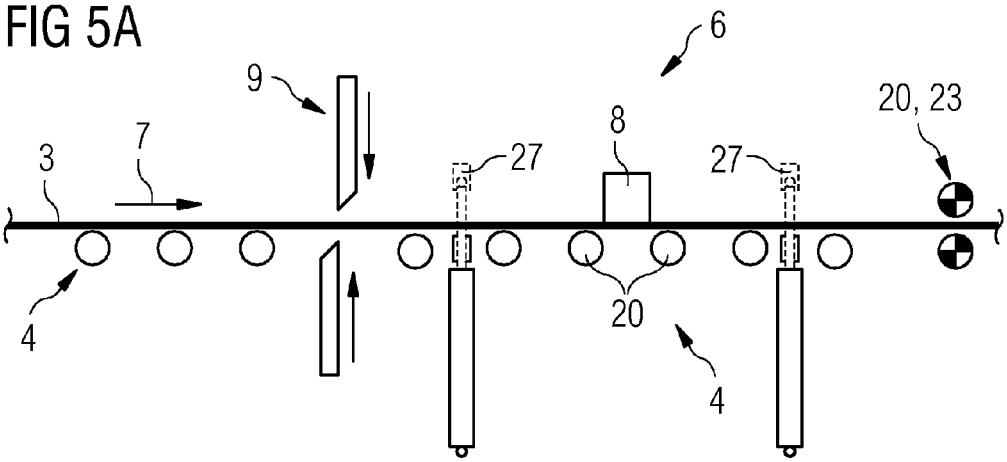
Figure 5B:
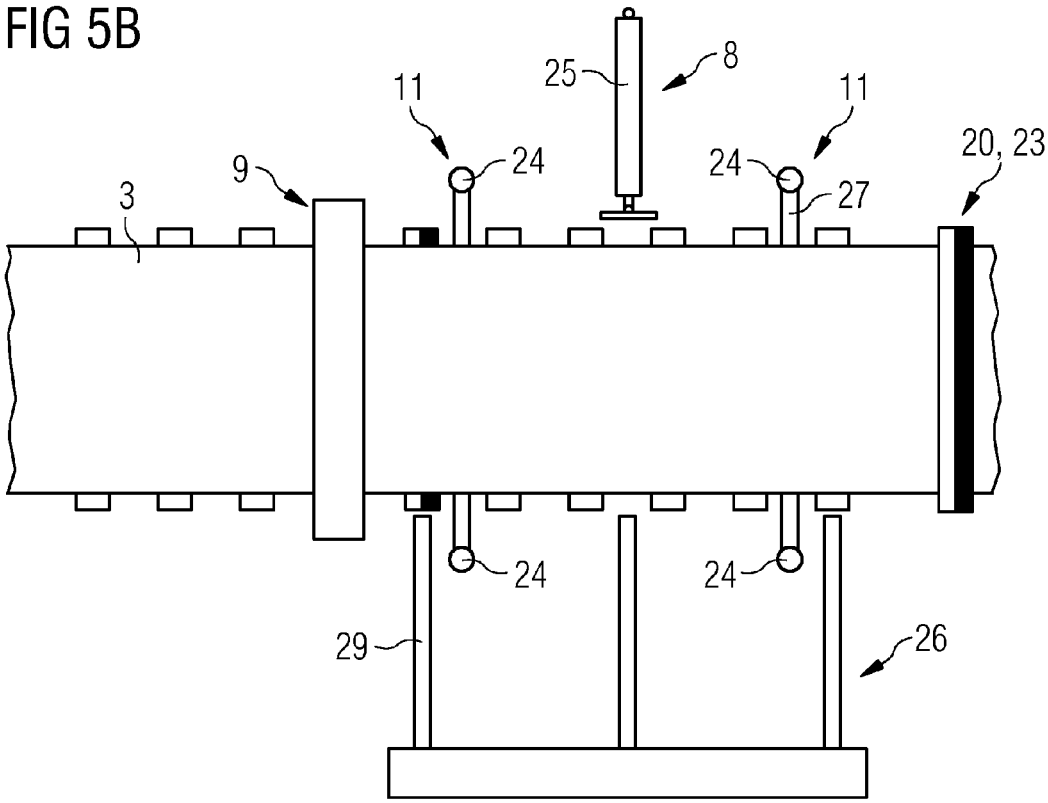

FIGS. 5A and 5B shows a second inventive embodiment of the cutting up and delivery device 6, which can likewise be used with the combined casting-rolling installation 1 in accordance with FIG. 1. It differs from the first embodiment in that a front raising device 11, a delivery device 8, a rear raising device 11, and the clamping device 23 are disposed downstream of the shears 9 in the transport direction. As in FIGS. 3A, 3B, a strand portion can be lifted by the two raising devices 11. The preliminary material 3 coming after is again cut off by the shears 9 into preliminary material portions 10 which can be pushed off by the push cylinder 25 of the delivery device 8 from the rollers 20 of the roller table 4 in the horizontal direction onto the support arms 29 of a stacking device 26.

In the first and second embodiment of the invention a preliminary material portion 10, viewed in the outline from the delivery device 8 of the drawing, is pushed out. Naturally it would be just as easily possible to modify the delivery device 8 so that a preliminary material portion 10 is delivered into the plane of the drawing. An apparatus suitable for this purpose is known from WO 2009/121678 A1.

Although the invention has been illustrated and described in greater detail on the basis of the preferred exemplary embodiments, the invention is not limited by the disclosed examples and other variations can be derived herefrom by the person skilled in the art without departing from the scope of protection of the invention.

LIST OF REFERENCE CHARACTERS

1 Continuous casting-rolling installation
2 Continuous casting machine
3 Preliminary material
4 Roller table
5 Preliminary rolling train
6 Cutting up and delivery device
7 Transport direction
8 Delivery device
9,9*a*,9*b* Shears
10 Preliminary material portion
11 Raising device
12 Heating section
13 De-blistering installation
14 Finishing rolling train
15 Cooling section

16 Shears
17 Storage device
18 Lowerable roller table
19 Scrap piece
20 Roller
21 Strand portion
22 Crane
23 Clamping device
24 Raising cylinder
25 Pushing cylinder
26 Stacking device
27 Raising bar
29 Support arm

The invention claimed is:

1. A method for manufacturing hot-rolled strip in a continuous casting-rolling installation comprising:

1) performing an endless operation comprising solidifying a strand with slab or thin slab cross-section of an endless strand-cast preliminary material, after complete solidification of the strand, passing the strand uncut through a cutting up and delivery device on a roller table in a transport direction, subsequently hot-rolling the strand in a finishing rolling train, then cooling down, cutting and storing the hot rolled material or strip;

2) for bridging an interruption in production in a part of the installation which is located downstream in the transport direction from the cutting up and delivery device, the method further comprising performing the following steps in the cutting up and delivery device:

a) cutting off the endless strand-cast preliminary material into a strand portion by using shears;

b) clamping the strand portion by a clamping device pressing a pair of opposing rollers onto the strand portion downstream of the strand raising device in the transport direction, thereby immobilizing the strand portion against movement in the transport direction;

c) raising a trailing tail part of the strand portion from the roller table using a raising device for pulling the tail part of the strand portion away from the shears in the transport direction;

d) cutting the preliminary material that is passing the shears to form a preliminary material portion using the shears;

e) delivering the preliminary material portion from the rolling table using a delivery device, and f) removing the strand portion until the operational readiness of the continuous casting-rolling installation is restored.

2. The method as claimed in claim 1, further comprising raising the tail part of the strand portion in a vertical direction using a raising bar.

3. The method as claimed in claim 1, further comprising during the cutting of the preliminary material, the shears cutting off the passing preliminary material into preliminary material portions.

4. The method as claimed in claim 3, further comprising during the delivering, pushing the preliminary material portion away transversely to the transport direction.

5. The method as claimed in claim 3, wherein the cutting off of the passing preliminary material is into the portions having a length of 8 to 14 m.

6. The method as claimed in claim 1, further comprising during the removing, lifting the strand portion in a vertical direction using a crane.

* * * * *